United States Patent [19]

Johnsson

[11] 4,102,485

[45] Jul. 25, 1978

[54] TRANSPORT BOX

[75] Inventor: Sven Johnsson, Huskvarna, Sweden

[73] Assignee: Pacfex Aktiebolag, Kinna, Sweden

[21] Appl. No.: 746,686

[22] Filed: Dec. 2, 1976

Related U.S. Application Data

[63] Continuation of Ser. No. 682,670, May 3, 1976, abandoned.

[51] Int. Cl.[2] ..... B65D 11/20; B65D 61/00

[52] U.S. Cl. ..... 229/23 R

[58] Field of Search ..... 229/23 R, 23 C, 34 R, 229/45, 44

[56] References Cited

U.S. PATENT DOCUMENTS

| | | | |
|---|---|---|---|
| 3,373,921 | 3/1968 | Crane | 229/23 R |
| 3,417,909 | 12/1968 | Stern | 229/23 R X |
| 3,478,867 | 11/1969 | Weiss | 229/2.5 X |
| 3,512,696 | 5/1970 | Ebert | 229/30 |
| 3,632,037 | 1/1972 | Webb et al. | 229/23 R |
| 3,915,372 | 10/1975 | Crane | 229/23 R |
| 3,935,991 | 2/1976 | Crane | 229/23 R |

*Primary Examiner*—Davis T. Moorhead

*Attorney, Agent, or Firm*—Holman & Stern

[57] ABSTRACT

A multipart, collapsible box for transporting small items being made of a folded sheet casing and two end elements. The casing is folded to form a bottom, side walls and inwardly extending flanges. The end elements are adapted to have the end edges of the casing to be fitted and secured therein. Each end element has two side portions, each with a projection to be fitted into a hole in the respective side wall of the casing for securing the end element to the casing. Guide bars are provided on the end elements for stiffening the same and for guiding the bottom of the casing into a track formed by the bottom of the guide bars and a bottom flange on the end element. Further guide bars are formed in the upper corners of the end elements for guiding and holding the side walls and the flanges of the casing into place. A central wall portion of the end elements is formed sloping inwardly between the bottom flange and the top flange to form a handle on each end element. The end elements are made of plastic and the casing of cardboard or similar pliable material. The end elements can be perforated for ventilation.

11 Claims, 7 Drawing Figures

TRANSPORT BOX

This is a continuation of application Ser. No. 682,670, filed May 3, 1976 now abandoned.

BACKGROUND OF THE INVENTION

The present invention relates to multipart boxes, more particularly, to collapsible reusable, multipart boxes for transporting small items.

The German Offenlegungsschrift No. 2,347,558 disclosures a transport box consisting of a number of parts to be joined together.

The purpose of the invention is to make a transport box of the kind which consists of few parts, has a low weight, and is easy to assemble. The assembled box can be used for transporting small items such as berries and fruits.

The invention is described in detail below in connection with the enclosed drawings.

Figure 1:
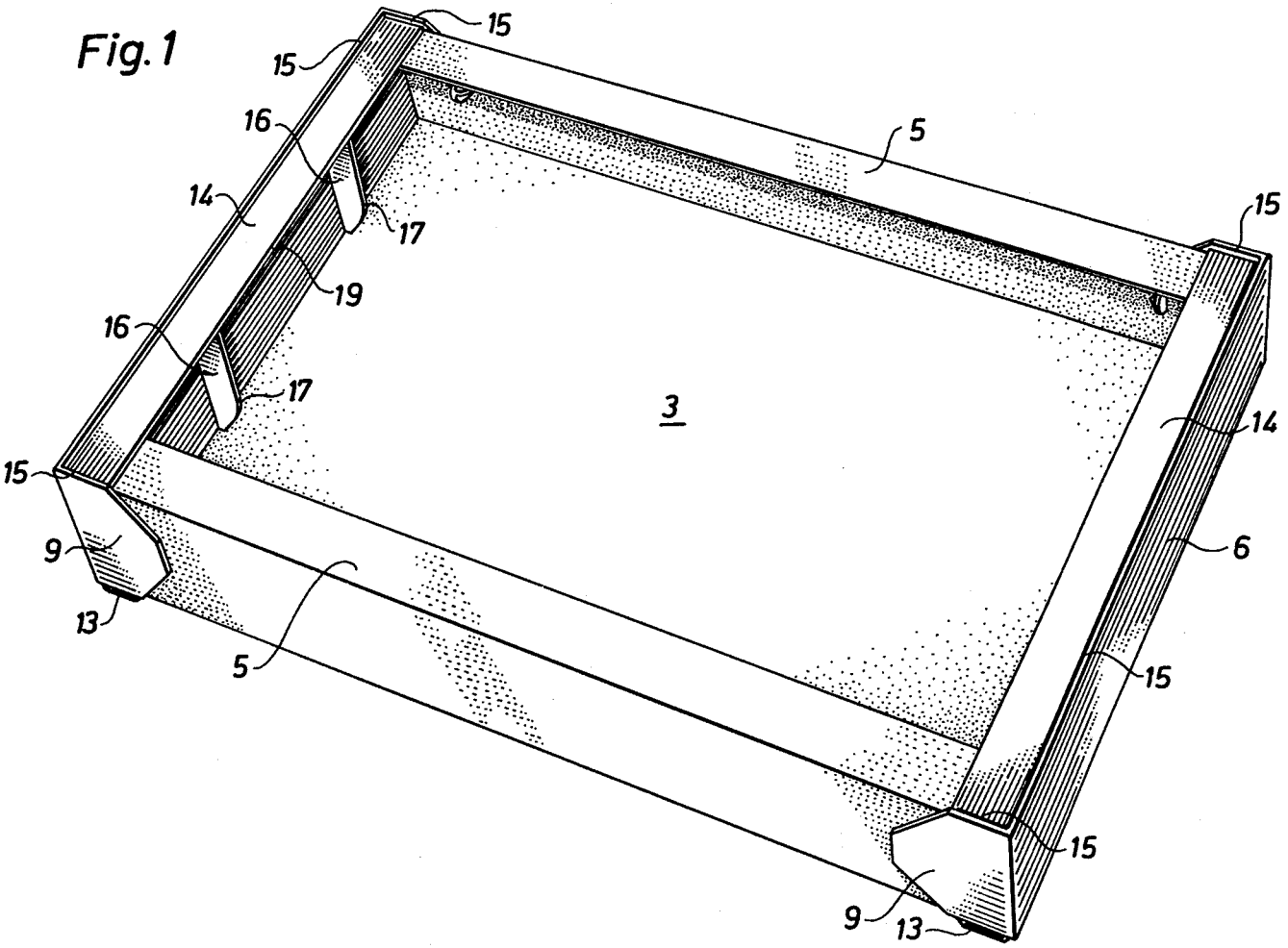
FIG. 1 is a perspective view of an assembled transport box.
Figure 2:
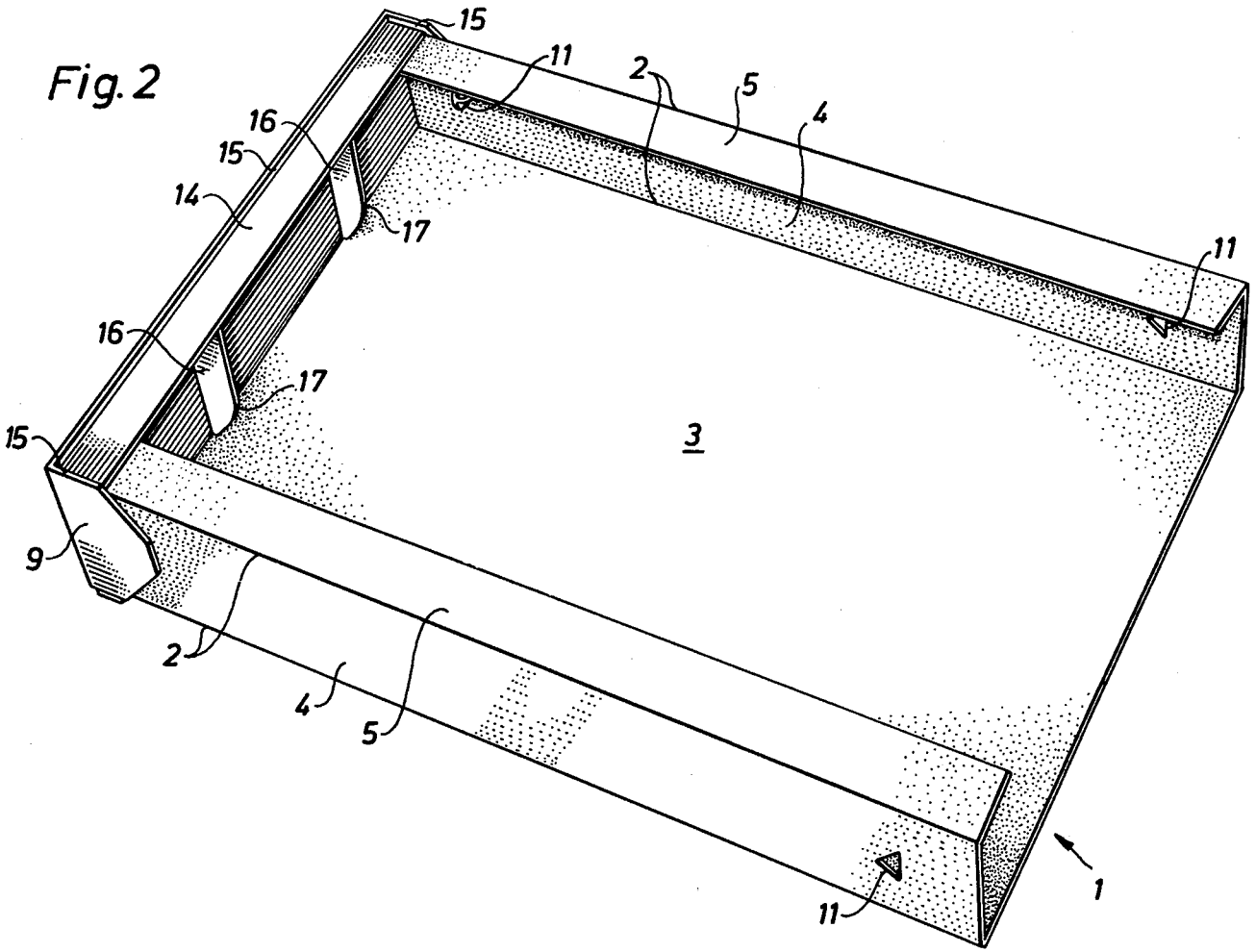
FIG. 2 shows the transport box without one end element.

The transport box shown consists of three parts, namely, a casing and two end elements. The rectangular casing 1 is made of cardboard or another pliable material in sheet form. The sheet is folded along four folding lines 2, which are parallel to each other, thereby forming with a rectangular bottom part 3, rising sides 4 forming both long sides of the transport box, and flanges 5 forming the edges. The casing is inserted in end elements 6 made mainly of plastic equipped with tracks 7 and guide bars 8 for securing the casing to the end elements. Each end element has a fixed flap side portion 9 fitting tightly against the side 4 of the casing at right angles to the end element. Each side portion is fitted on the inside with a fixing tap or projection 10, which engages in openings 11 in the side of the casing. In this way the casing has been attached to the end element in question. The bottom of the casing 3 keeps lower portion of the sides 4 of the casing spread and the guide bars 8 keep the upper portion of the sides the spread, which contributes to keeping the projections 10 tightly fitted into the openings 11.

As appears from FIGS. 2-7 the have been shaped with bottom flange 12, which is parallel with the bottom 3 of the casing, against which the casing rests. The ends of the bottom flanges 12 are equipped with or shaped with feet 13 for the support of the transport box against a foundation. Each of the end elements has a top flange 14 fitting tightly against ends of the flanges 5 of the casing, which ends at the same time are in contact from above with the top of the guide bars 8.

In case of stacking of several transport boxes on top of each other, the feet 13 of one transport box will stand upon the top flanges 14 of the transport box below. In order to secure the position of the transport boxed stacked upon each other the end elements have been shaped with lips 15 projecting from the top flanges, which will prevent the feet from sliding down from the transport box on which they stand. The feet also help in spacing the transport box from the one below so that an air gap is obtained between the boxed standing upon each other, which will increase the ventilation.

The end elements are shaped with one or more vertical stiffeners 16 between the top flange 14 and the bottom part of the end element, which support the top flange. As appears in FIG. 16 the outside edge 17 of the stiffeners 16 is inclined downwards towards the line 27, from which the bottom flange 12 starts from the inside of the end element, so that when the end element is pushed upon a casing, the stiffeners 16 will work as guide bars to guide the edge part of the bottom 3 of the casing to the position indicated in FIG. 7 by dashed lines. The outside edge 17 is parallel with the nearest line 27 and somewhat above the bottom flange 12 of the end element to form part of the track 7 to keep the edge part of the bottom 3 of the casing in the intended position for the assembled transport box. So that when the transport box is assembled, the edge parts of the sides 4 and flanges 5 of the casing are directed to the intended position in the end elements 6, the guide bars 8, which are situated close to the two top corners of the end element against the vertical edges 21 of the inside of the end element, have, inclined guiding outside edges 22. The other edge 23 of the guide bars 8 is inclined vertically towards the line 24, from which the top flange 14 projects from the inside of the end element. The outside of the inclined edges 22 and 23 run near the inside of the end element parallel with the side portion 9 and the top flange 14, respectively, and at some distance from these to forms track 25 and track 26, respectively, thus keeping the sides 4 and flanges 5 of the casing in the intended position for the assembled transport box.

At least the central wall part 18 of the end element between two stiffeners 16 can be arranged so that it is inclined inwards towards the inside edge 19 of the top flange 14. The portion of the top flange outside of the central wall part mentioned thus makes up a handle 20, in which you hold when the transport box is to be moved.

Figures 3, 4:
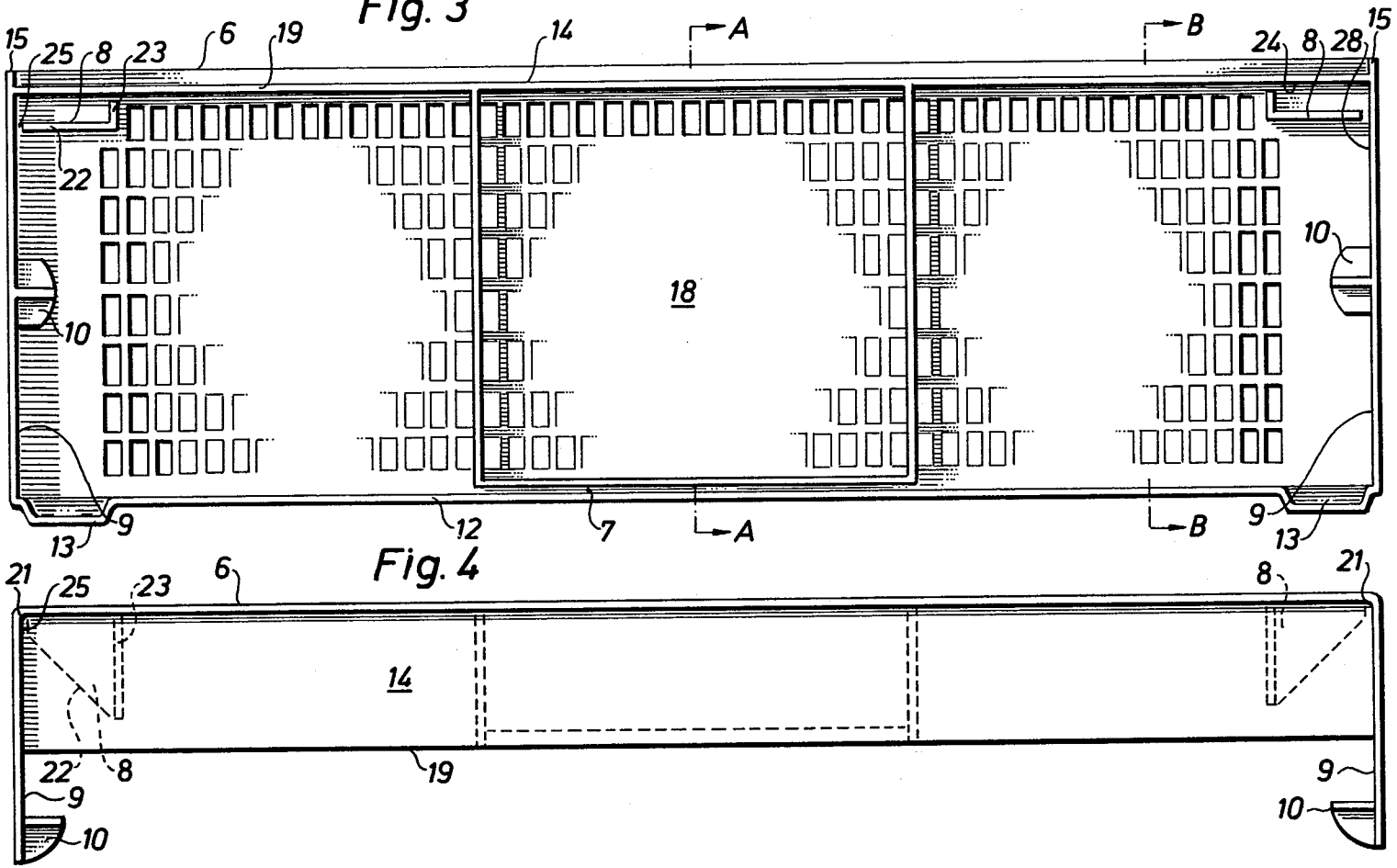
FIG. 3 is a view of a an end element seen from the inside of the transport box.
FIG. 4 is a view of the end element seen from above
Figure 5:
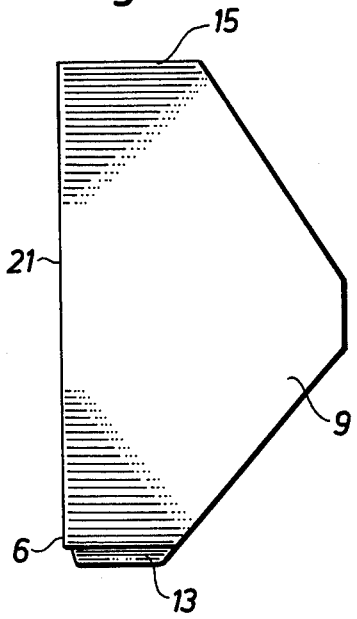
FIG. 5 is an end view of the end element seen from the left in FIG. 3.
Figure 6:
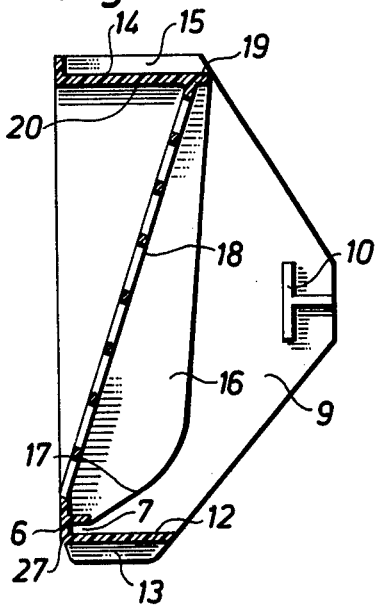
FIGS. 6 and 7 are sections along the line A—A and B—B respectively, in FIG. 3. Thus, in FIG. 7, the side portion of an end element is shown with a cardboard casing inserted therein which is shown with dashed lines.
Figure 7:
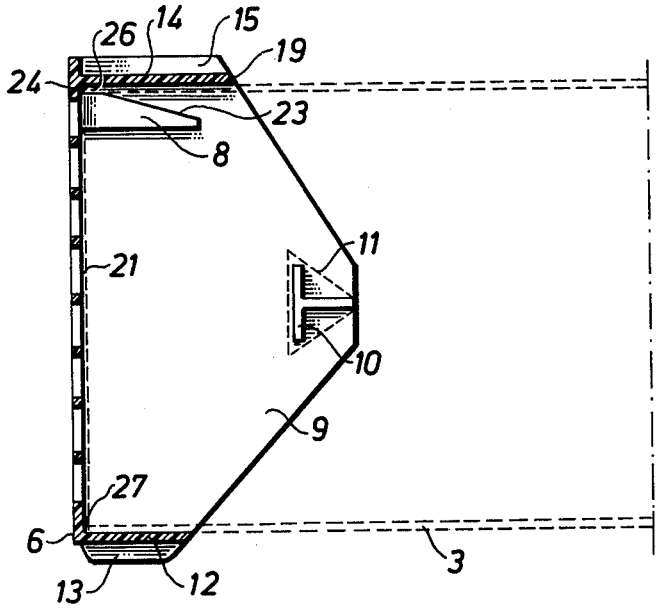

The ventilation of the inside of the transport box is greatly improved if the end elements are made with open or perforated sides, such as is indicated in FIGS. 3, 6, and 7.

Because the transport box according to the invention is easy to put together and then easy to take apart, the transportation of empty boxes is also easy. The flatly unfolded casings could thus be transported stacked upon each other and in this way they do not take up much room. The end elements could be transported individually laid upon each other. If the side portions 9 are made to swing round a folding line 21, made through a weakening of the plastic material, the end elements could be packed more tightly together. In that case the fixing projections 10 and the holes 11 are shaped so that the side portions are kept firmly in position when transport box is assembled.

The invention can be modified within the scope of subsequent patent claims. Thus, the fixing projections 10 can be replaced by one or more studs. Instead of the separate guide bars, made up by the stiffeners 16, the whole of or part of the long side of the end element can be shaped as a guide for the ends of the casing.

What I claim is:

1. A box comprising a casing made of a sheet which is folded to form a bottom and two side walls, each with inwardly-extending flanges on their top edges; and two end elements adapted to receive the opposite ends of the folded casing and to fix them relative to the end elements, each said end element comprising side portions adapted to lie along the side walls of the casing and to positively engage therewith; guide bars with guiding edges which slope towards the bottom edges of the insides of the end elements to guide the opposite end of the casing towards said bottom edges during assembly; a bottom flange at said bottom edge to support the bottom of the casing; and an inwardly directed projection on each side portion of each end element engaging in a hole in each respective side wall for positive engagement therewith.

2. The box as claimed in claim 1, wherein the end elements are of plastics material.

3. The box as claimed in claim 1, wherein said end elements further comprise further guide bars with further guiding edges for guiding the tops of the side walls into the end elements during assembly.

4. The box as claimed in claim 3, wherein said further guide bars have additional edges for guiding the flanges on the side wall top edges into the end elements during assembly.

5. The box as claimed in claim 4, wherein a parallel-sided track is formed between the guiding edges and flanges at the edges of the insides of the end elements so as to positively locate the respective parts of the casing in the end elements on assembly.

6. The box as claimed in claim 5, wherein the guide bars are at right angles to the insides of the end elements.

7. The box as claimed in claim 1, wherein the guide bars additionally are stiffeners for the end elements.

8. The box as claimed in claim 1, wherein the side portions are mounted on the end elements in such a way that they can be folded from their operative position, at right angles to the planes of the end elements, into the planes of the end elements.

9. The box as claimed in claim 1, wherein each end element further comprises a top flange and a central, inwardly sloping wall portion sloping inwardly from said bottom flange to said top flange to form a handle.

10. The box as claimed in claim 9, wherein said inwardly sloping wall portion is bounded on either side by said guide bars.

11. The box as claimed in claim 1, wherein the end elements are perforated to assist in ventilation of the box, when assembled.

* * * * *